US005562317A

United States Patent [19]

Kuo et al.

[11] Patent Number: 5,562,317

[45] Date of Patent: Oct. 8, 1996

[54] INNER HANDLE ASSEMBLY OF CYLINDER LOCK

[75] Inventors: Ching-Chuan Kuo, Chia-Yi Hsien; Ming-Shyang Chiou, Chia-Yi; Cheng-Wen Lai, Chia-Yi Hsien, all of Taiwan

[73] Assignee: Tong-Lung Metal Industry Co., Ltd., Taipei, Taiwan

[21] Appl. No.: 406,496

[22] Filed: Mar. 20, 1995

[51] Int. Cl.[6] ..... E05B 13/00

[52] U.S. Cl. ..... 292/359; 292/DIG. 26

[58] Field of Search ..... 292/359, DIG. 26

[56] References Cited

U.S. PATENT DOCUMENTS

| | | | |
|---|---|---|---|
| 2,499,948 | 3/1950 | Egor | 292/359 |
| 5,083,823 | 1/1992 | Fann et al. | 292/DIG. 26 X |
| 5,286,074 | 2/1994 | Lin | 292/359 X |

*Primary Examiner*—Rodney M. Lindsey

*Attorney, Agent, or Firm*—Ladas & Parry

[57] ABSTRACT

An inner handle assembly of a door lock includes a handle with an axle. A mounting cap has an axial hole for passage of the axle and a through-hole offset from the axial hole. A spindle driving plate has a central hole engaging fittingly a spindle of the door lock. A manually operable lock unit has a button member extending outwardly through the through-hole and mounted for movement in an axial direction between locking and unlocking positions, and an engagement member in connection with the button member. The engagement member engages the spindle driving plate for locking against rotation of the spindle driving plate when the lock unit is at the locking position. A rotary member is mounted on the axle within the mounting cap for rotating simultaneously the axle. The rotary member moves axially and outwardly the engagement member to disengage from the spindle driving plate when the axle is turned to rotate the rotary member. The axle retards rotation of the spindle driving plate so that the spindle driving plate starts to rotate after the lock unit is moved to the unlocking position.

8 Claims, 11 Drawing Sheets

INNER HANDLE ASSEMBLY OF CYLINDER LOCK

BACKGROUND OF THE INVENTION

1. Field of the Invention

This invention relates to an inner handle assembly of a cylinder lock, more particularly to an inner handle assembly which incorporates a manually operable lock unit that can lock a door from the inside of the door without using any key so as to prevent opening of the door from the outside.

2. Description of the Related Art

Generally speaking, a conventional cylinder lock includes inner and outer handle assemblies mounted respectively to two opposite sides of a door, and a spindle connecting the inner handle assembly to the outer handle assembly for actuating a bolt of the cylinder lock by virtue of operation of the inner handle assembly or the outer handle assembly in order to open the door. The conventional cylinder lock further includes a manually operable lock unit installed on the inner handle assembly and to be operated from the inside of the door without using any key so as to prevent opening of the door from the outside. The releasing operation of the conventional door lock is conducted by turning an inner handle of the inner handle assembly or an outer handle of the outer handle assembly so as to rotate the spindle to actuate the bolt after the lock unit is moved to its unlocking position. In case the manually operable lock unit is to be unlocked, the push button of the lock unit has to be pulled manually prior to turning of the inner handle or the outer handle. Accordingly, it is quite. inconvenient to operate the conventional door lock.

In order to improve the above described drawback, U.S. Pat. No. 5,083,823 has disclosed a latch bolt operating device to be mounted to a door. As disclosed, the latch bolt operating device includes a manually operable locking shaft installed between outer and inner handle assemblies of the latch bolt operating device for locking the door without using any key, an inner spring-loaded rotary plate mounted to an inner handle of the inner handle assembly for rotating simultaneously therewith, and a cam member provided on the rotary plate for camming the locking shaft to its unlocking position when the rotary plate is rotated by virtue of turning of the inner handle, thereby unlocking the latch bolt operating device.

However, since the manually operable locking shaft is interconnected to the inner and outer handle assemblies, when it is desired to mount the latch bolt operating device to a door, the inner and outer handle assemblies of the latch bolt operating device have to be mounted precisely at predetermined positions of the door in order to facilitate installing of the locking shaft between the inner and outer handle assemblies. Accordingly, it is quite inconvenient to mount such latch bolt operating device to the door.

SUMMARY OF THE INVENTION

Therefore, the objective of he present invention is to provide an inner handle assembly of a door lock which ha a manually operable lock unit that can lock a door from the inside thereof without using any key so as to prevent the door from being opened from the outside of the door and that is cooperatively connected to the spindle of the door lock, i.e. a primary component to drive a bolt, so that the lock unit need not be connected to an outer handle assembly for locking the outer handle assembly against rotation or for preventing the door from being unlocked from the outside of the door.

According to this invention, an inner handle assembly of a door lock is connected to an outer handle assembly of the door lock by means of a spindle for actuating a bolt of the door lock by virtue of operation of the inner handle assembly or the outer handle assembly in order to open a door. The inner handle assembly includes a handle with an axle. A mounting cap is provided around the axle, and has an axial hole for passage of the axle and a through-hole offset from the axial hole. A spindle driving plate has a central hole engaging fittingly the spindle. A manually operable lock unit has a button member which extends outwardly through the through-hole of the mounting cap and which is mounted for movement in an axial direction between a locking position and an unlocking position, and an engagement member in connection with the button member. The engagement member engages the spindle driving plate for locking against rotation of the spindle driving plate without being restricted from axial movement relative to the spindle driving plate when the manually operable lock unit is at the locking position. A rotary member is mounted on the axle of the handle within the mounting cap for rotating simultaneously the axle. The rotary member has means for moving the engagement member axially and outwardly of said mounting cap to disengage from the spindle driving plate when the axle is turned to rotate the rotary member.

The axle of the handle has a connecting means connected to the spindle driving plate for retarding rotation of the spindle driving plate so that the spindle driving plate starts to rotate after the manually operable lock unit is moved to the unlocking position. The connecting means has at least one arcuate driving wing which projects axially from and which is formed integrally with a joint end of the axle. The spindle driving plate has at least one arcuate receiving slot formed therein to engage the driving wing. The receiving slot is slightly longer than the driving wing, and the driving wing is limitedly slidable in the receiving slot so that commencing rotation of the spindle driving plate lags behind that of the axle.

The mounting cap further has an integrally formed tubular member projecting inwardly around the through-hole to guide and mount the manually operable lock unit, and a cover plate secured to the mounting cap to cover the integrally formed tubular member.

The engagement member has a tubular body with a peripheral surface. The spindle driving plate has an outer peripheral edge and a projection extending radially and outwardly from the outer peripheral edge. The projection is engageable with the engagement member against rotation of said spindle driving plate while being slidable axially relative to the engagement member. The projection has a notched edge to ride on and to engage he peripheral surface of the tubular body.

The engagement member further has a stud projecting radially from the peripheral surface of the tubular body. The rotary member has an annular plate with an outer peripheral edge. The moving means of the rotary member has a cam part projecting radially and outwardly from the outer peripheral edge of the annular plate to engage the stud of the engagement member so as to cam the manually operable lock unit to the unlocking position after the rotary member is rotated. The cam part is a curved plate which has a concaved surface to receive the stud of the engagement member when the locking unit is depressed to the locking position, and a gradually convexed surface for camming and pushing the stud of the engagement member when the rotary member is rotated.

In one embodiment, the inner handle assembly includes a handle with an axle, a mounting cap with an axial hole for passage of the axle and a through-hole offset from the axial hole, and a spindle driving plate with a central hole engaging fittingly a spindle of a door lock for rotating the spindle to actuate the door lock. A manually operable lock unit has a button member which extends outwardly through the through-hole of the mounting cap and which is mounted for movement in an axial direction between a locking position and an unlocking position, and an engagement member in connection with the button member. The engagement member engages the spindle driving plate for locking against rotation of the spindle driving plate without being restricted from axial movement relative to the spindle driving plate when the manually operable lock unit is at the locking position. A rotary member is mounted on the axle of the handle within the mounting cap for rotating simultaneously with the axle, and has means for locking the engagement member so as to restrict the manually operable lock unit in the locking position. The locking means releases the engagement member after the axle is turned by a predetermined angle. A spring member is associated with the manually operable lock unit to move the manually operable lock unit to the unlocking position after the engagement member is released.

The axle of the handle has a connecting means connected to the spindle driving plate for retarding rotation of the spindle driving plate so that the spindle driving plate starts to rotate after the manually operable lock unit is moved to the unlocking position. The mounting cap further has an integrally formed tubular member projecting inwardly around the through-hole to guide and mount the manually operable lock unit, and a cover plate secured to the mounting cap to cover the integrally formed tubular member. The spring member is mounted within the integrally formed tubular member and the cover plate o bias the manually operable lock unit.

The rotary member has an annular plate with an outer peripheral edge, and a tongue projecting radially and outwardly from the outer peripheral edge of the annular plate. The engagement member further has a circumferential groove formed in an outer peripheral surface thereof. The tongue of the rotary member extends into the circumferential groove of the engagement member at a predetermined angular position of the rotary member and moves away from the circumferential groove when the rotary member turns away from the predetermined angular position.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMEMTS

Figures 1, 2:
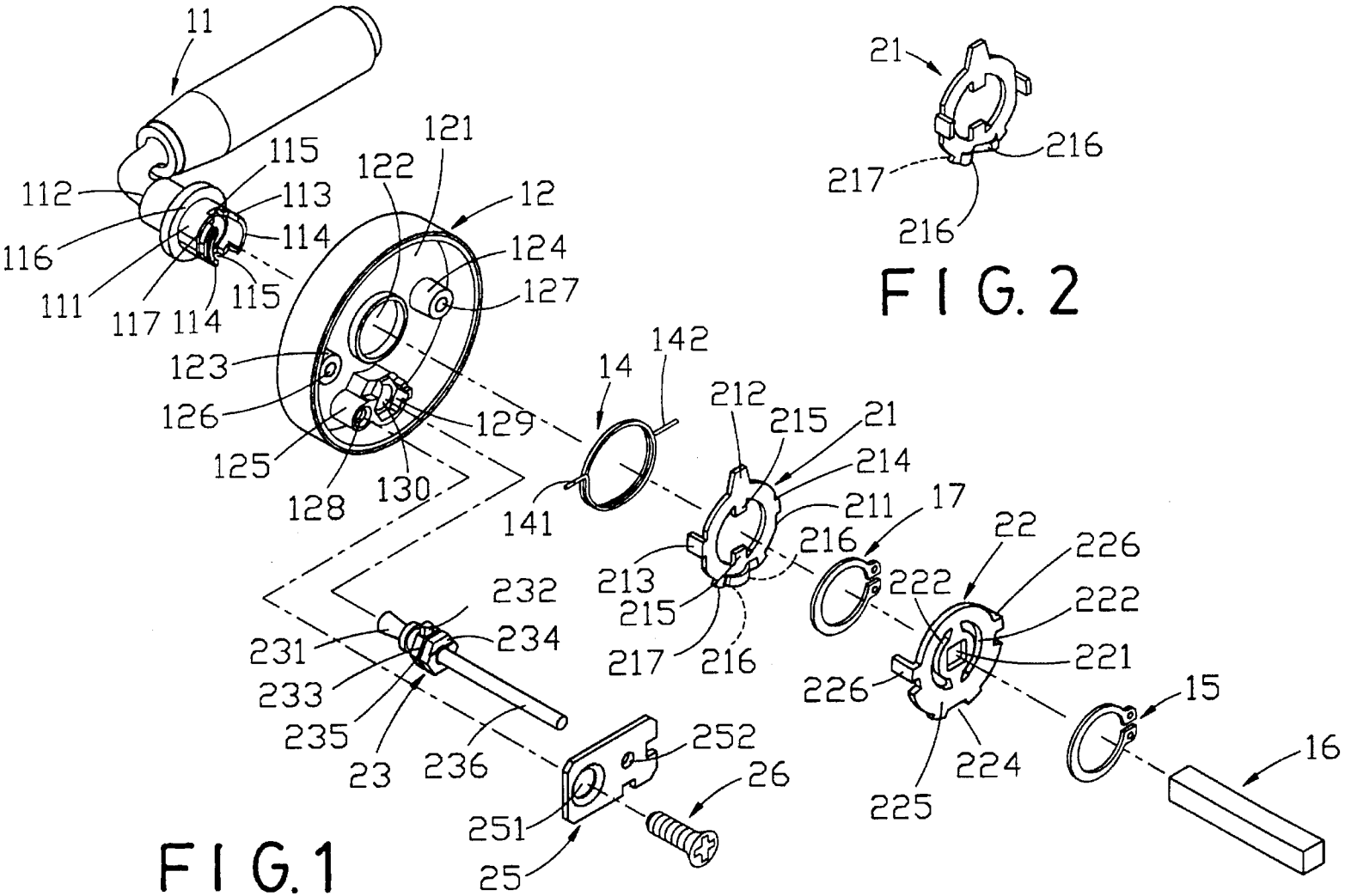
FIG. 1 is an exploded view showing the first preferred embodiment of an inner handle assembly of a door lock according to this invention.
FIG. 2 is a perspective View showing a rotary member of the inner handle assembly according to the first embodiment of this invention.

Referring to FIG. 1, the first preferred embodiment of an inner handle assembly of a door look according to this invention is connected to an outer handle assembly of the door lock by means of a spindle 16 of the door lock in a known manner for actuating a bolt of the door lock by virtue of operation of the inner handle assembly or the outer handle assembly in order to open a door. It should be noted that the outer handle assembly, the spindle 16 and the bolt of the door lock are conventional in constitution and will not be described in the following paragraphs. In addition, like elements in the following different embodiments are denoted by the same reference numerals.

The first embodiment of the inner handle assembly includes a handle 11 which has an axle 112 with a joint end 111. The handle 11 in this embodiment is a lever handle but can also be a handle of other types, such as a knob. A pair of spaced and opposed arcuate driving wings 114 project axially from and are formed integrally with the joint end 111 of the axle 112 to define two diametrically aligned notches 115 therebetween. A first annular groove 113 is formed in and around the peripheral surfaces of the driving wings 114. A second annular groove 117 is formed in and around the peripheral surfaces of the driving wings 114 and is spaced axially from the first annular groove 113 at a predetermined distance.

A mounting cap 12 is provided around he axle 112 of the handle 11. The mounting cap. 12 has a wall 121 transverse to the axle 112, an axial hole 122 formed through the wall 121 for passage of the axle 112, and two diametrically spaced tubular bolt seats 123, 124 secured to an inner surface of the wall 121 and having their holes 126, 127 extending through the wall 121. Thus, the mounting cap 12 can be mounted securely to an inside wall of a door by extending two bolts (not shown) through the holes 126, 127 to engage the inner wall of the door. The axle 112 of the handle 11 further has an annular flange 116 formed on an outer peripheral surface thereof to engage an outer surface of the wall 121 when the axle 112 passes through the axial hole 122 of the mounting cap 12, for positioning the axle 112. The mounting cap 12 further has a tubular bolt seat 125 with an internally threaded hole 128, a through-hole 130 offset from the axial hole 122, and an integrally formed tubular member 129 which projects axially and inwardly from the wall 121 around the through-hole 130.

Figure 3:
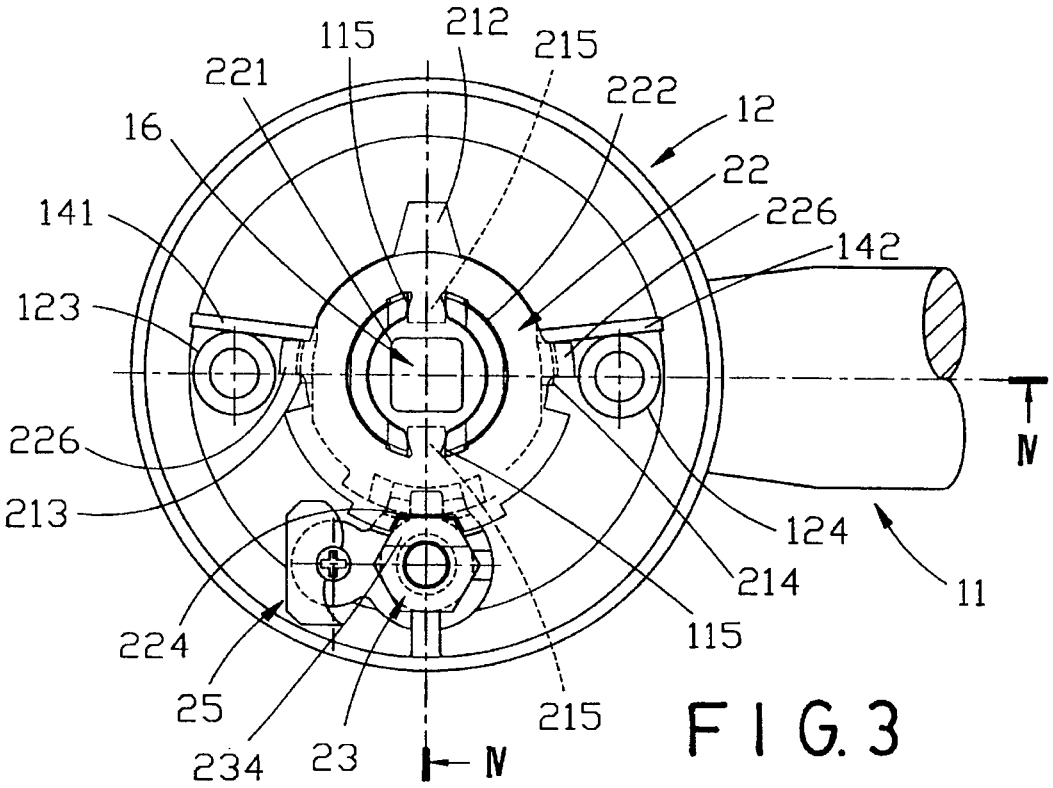
FIG. 3 is an elevational front view showing the first embodiment of the inner handle assembly of this invention.

A flat spiral spring 14 is sleeved on the joint end 111 of the axle 112 of the handle 11 and has two legs 141, 142 which extend radially and outwardly to rest respectively against the bolt seats 123, 124, as shown in FIG. 3, when the handle 11 is not actuated.

Referring again to FIGS. 1 and 3, a rotary member 21 has an annular plate 211 mounted on the joint end 111 of the axle 112, and a pair of diametrically opposed tongues 215 projecting radially and outwardly from an inner peripheral edge of the annular plate 211 to engage respectively and fittingly the notches 115 of the axle 112 such that the annular plate 211 can be rotated simultaneously with the axle 112. An outwardly and radially extending piece 212 is formed on an outer peripheral edge of the annular plate 211 and can be selectively blocked by one of the bolt seats 123, 124 when the annular plate 211 is rotated by virtue of the axle 112 in order to avoid overrotation of the annular plate 211 and the axle 112. A pair of diametrically spaced lugs 213, 214 project axially and outwardly from the outer peripheral edge of the annular plate 211 to engage the legs 141, 142 of the spring 14 (see FIG. 3).

Figure 5:
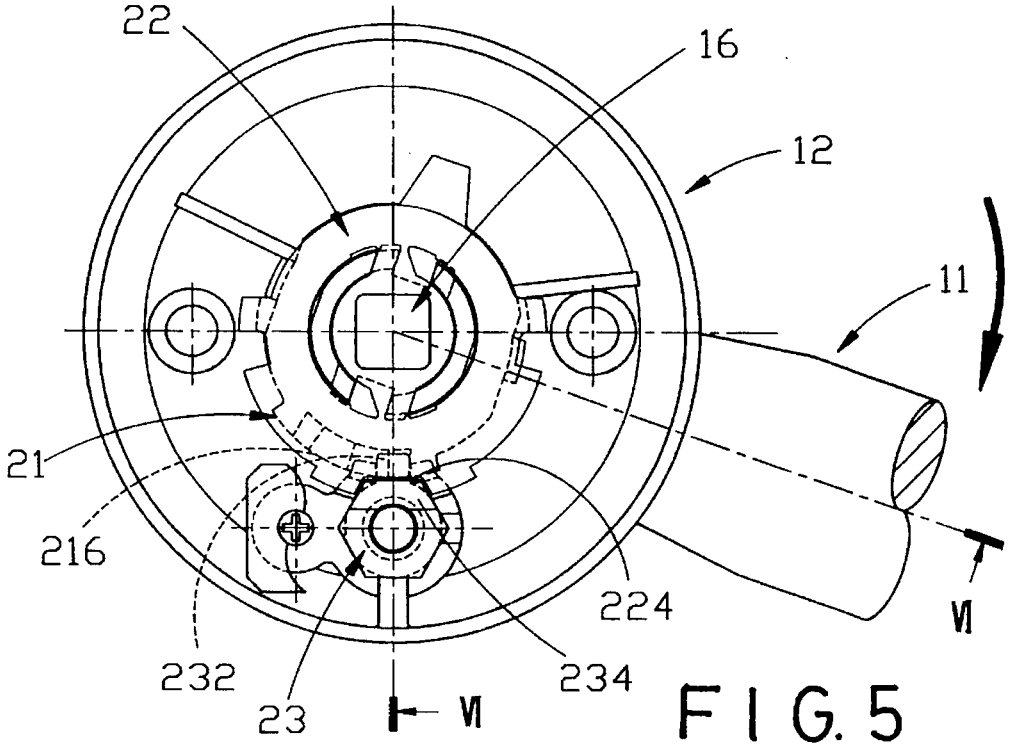
FIG. 5 is a schematic view illustrating operation of the inner handle assembly in accordance with the first embodiment of this invention.

Referring to FIG. 5, when the annular plate 211 is turned by virtue of operation of the handle 11, a torsion force in the spring 14 can return the handle 11 to its original unoperated position immediately when a force applied to operate the handle 11 is removed.

Referring again to FIGS. 1 and 3, a spindle driving plate 22 has a square central hole 221 formed therethrough for engaging fittingly one end of the spindle 16 so as to rotate spindle 16, and two opposite arcuate receiving slots 222 formed through the spindle driving plate 22 for passage of the driving wings 114 of the axle 112. Each of the receiving slots 222 is slightly longer than a respective one of the driving wings 114 so that the driving wings 114 are limitedly slidable in the receiving slots 222 respectively and act as a connecting means for retarding rotation of the spindle driving plate 22. Thus, commencing rotation of the spindle driving plate 22 lags behind that of the axle 112. The spindle driving plate 22 also has a pair of diametrically spaced tugs 226 which project axially and outwardly from an outer peripheral edge thereof and which are located at outwardly of the lugs 213, 214 (see FIG. 3) to engage the legs 141, 142 of the spring 14 in order to facilitate positioning of the spindle driving plate 22 by virtue of the torsion force in the spring 14.

Two resilient. C-shaped lock rings 15, 17 are mounted respectively in tile first and second annular grooves 113, 117 of the driving wings 114 at two sides of the spindle driving plate 22 (see FIG. 4) for avoiding axial movement of the spindle driving plate 22 relative to the driving wings 114.

Figure 4:
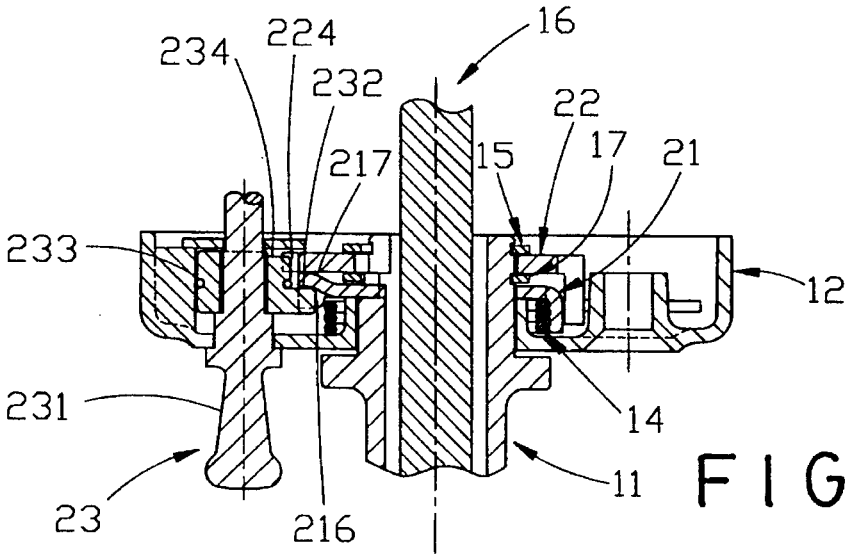
FIG. 4 is a sectional view, taken along line IV—IV of FIG. 3, showing the first embodiment of the inner handle assembly of this invention.

Referring FIGS. 1 and 4, a manually operable lock unit 23 includes a button member 231 which extends outwardly through the through-hole 130 of the mounting cap 12 and which is mounted for movement in an axial direction between a locking position (see FIGS. 3 and 4) and an unlocking position (see FIGS. 5 and 6), and an engagement member 234 which is mounted securely on and around one end portion of the button member 231 and which is confined within the tubular member 129 of the mounting cap 12. The engagement member 234 has an annular groove 233 formed in an outer peripheral surface thereof, and a C-shaped positioning ring 235 mounted in the annular groove 233 to engage frictionally an inner peripheral wall of the tubular member 129 in order to position the locking unit 23 at a desired position.

The spindle driving plate 22 further has a projection 225 which projects radially and outwardly from the outer peripheral edge thereof and which is formed with a notched edge 224 to ride on and to engage the outer peripheral surface of the engagement member 234 (see FIG. 4) when the lock unit 23 is at its locking position so as to block rotation of the spindle driving plate 22. Thus, the spindle 16 is locked by means of engagement between the engagement member 234 and the spindle driving plate 22 to lock the door lock. In this way, the door cannot be opened outside.

Figure 6:
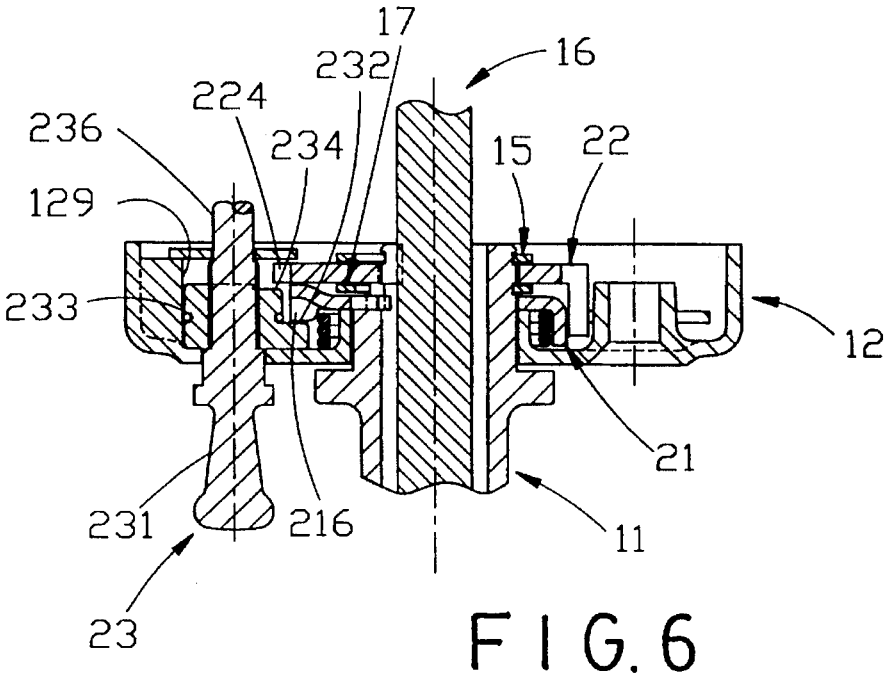
FIG. 6 is a sectional view, taken along line VI—VI of FIG. 5, showing the first embodiment of the inner handle assembly of this invention.

A stud 232 projects radially from the outer peripheral surface of the engagement member 234. The rotary member 21 has means for moving axially and outwardly the engagement member 234 to disengage from the spindle driving plate 22 when the axle 112 of the handle 11 is turned to rotate the rotary member 21. The moving means has a cam part 217 (as best shown in FIG. 2) projecting radially and outwardly from the outer peripheral edge of the annular plate 211 to engage the stud 232 (see FIG. 4). The cam part 217 is a curved plate having a concaved surface to receive the stud 232 of the engagement member 234 when the locking unit 23 is depressed manually to its locking position, and two gradually convexed surfaces 216 (see FIG. 2) at two sides of the concaved surface for camming and pushing the stud 232 during the rotation of the rotary member 21 so as to move the lock unit 23 to its unlocking position, as shown in FIGS. 5 and 6.

In this situation, the engagement member 234 disengaged from the notched edge 224 of the projection 225 of the spindle driving plate 22. Thus, the spindle driving plate 22 can be rotated by virtue of further rotation of the driving wings 114 of the axle 112 of the handle 11 so as to rotate the spindle 16 to actuate the bolt of the door lock, thereby unlocking the door lock. It should be noted that since the receiving slots 222 are slightly longer than the driving wings 114, the commencing rotation of the spindle driving plate 22 lags behind the rotations of the rotary member 21 and the axle 112. Therefore, the spindle driving plate 22 starts to rotate just after the lock unit 23 is moved to the unlocking position.

A cover plate 25 is secured to the mounting cap 12 by means of a bolt 26 which extends through a hole 251 of the cover plate 25 to engage threadably the internally threaded hole 128 of the mounting cap 12. Accordingly, the cover plate 25 can cover the tubular member 129 to enclose the engagement member 234 within the tubular member 129. The lock unit 23 further has an axially projecting bar 236 extending from an end surface of the engagement member 234 toward the outer handle assembly of the door lock via a hole 252 of the cover plate 25. An outer mounting cap of the outer handle assembly of the door lock has a through-hole (not shown) aligned with the hole 252 of the cover plate 25.

Accordingly, in case of an emergency, the user can insert a rod from the through-hole of the outer mounting cap to depress forcibly against the bar 236 so as to push the lock unit 23 to the unlocking position, thereby unlocking the door lock.

Because the inner handle assembly of this invention is applied usually to a door lock of a bathroom, it is necessary to install the above-described emergency means to the door lock. In addition, since the lock unit 23 is completely installed within the inner handle assembly of the door lock, the door lock can be easily mounted to a door without the need for aligning precisely the outer and inner handle assemblies at predetermined positions so as to mount the look unit therebetween.

Figure 7:
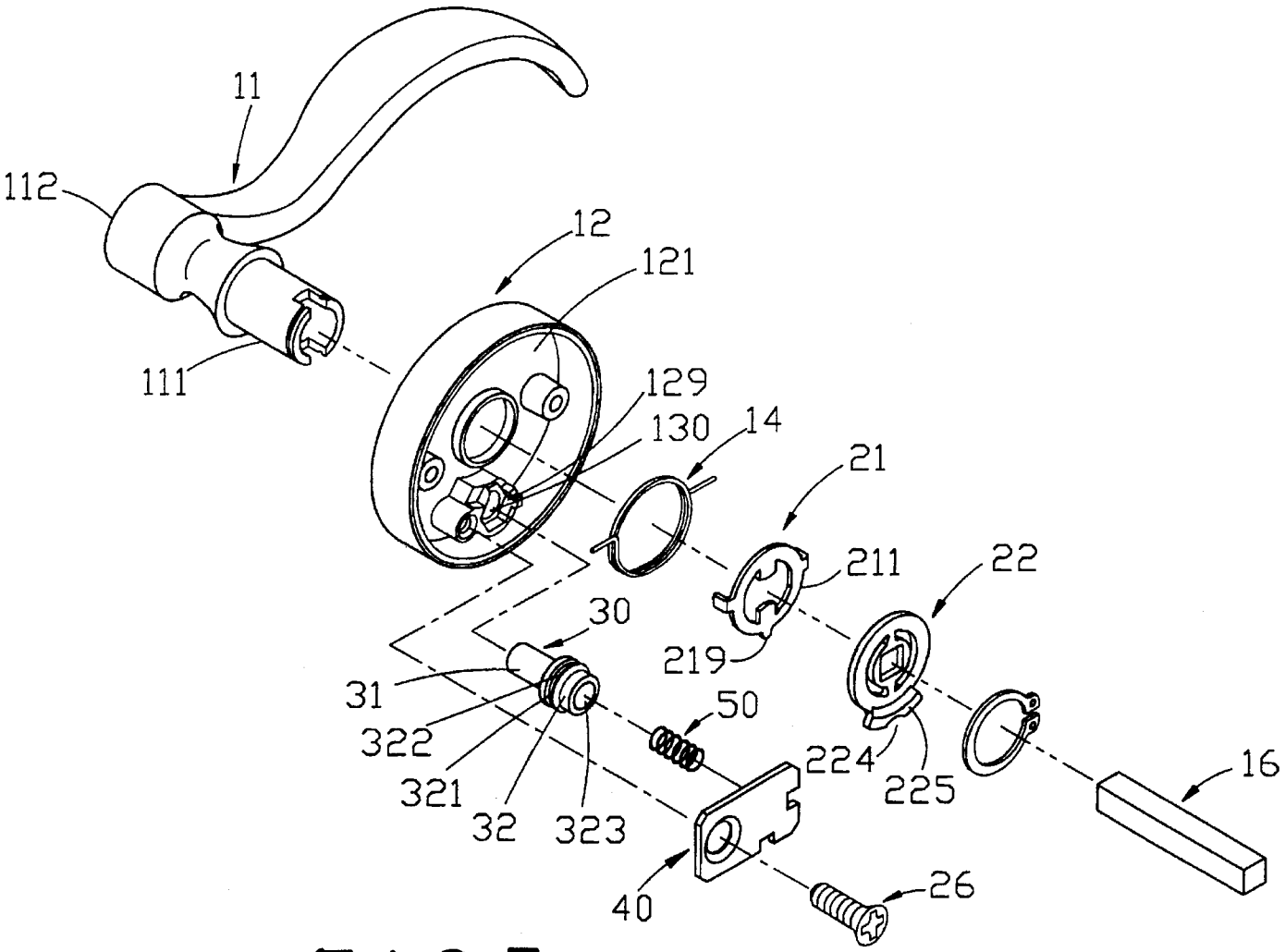
FIG. 7 is an exploded view showing the second preferred embodiment of an inner handle assembly of a door lock according to this invention.

FIG. 7 shows the second preferred embodiment of an inner handle assembly of this invention. As shown, the inner handle assembly includes a handle 11 with an axle 112, a mounting cap 12 provided around the axle 112, a flat spiral spring 14 sleeved on a joint end 111 of the axle 112, a rotary member 21 that is mounted on the joint end 111 of the axle 112 within the mounting cap 12 and that engages the spring 14 for returning the handle 11 to its original unoperated position in a manner similar to that described in the first embodiment, a spindle driving plate 22 mounted on the joint end 111 of the axle 112 to engage fittingly a spindle 16 of the door lock for rotating the spindle 16 when the spindle driving plate 22 is rotated by virtue of rotation of the axle 112 in a manner similar to that of the first preferred embodiment so as o actuate the door lock, and a manually operable lock unit 30 installed within the mounting cap 12 for selectively locking or unlocking the spindle driving plate 22, It should be noted that the parts of the second embodiment described above are similar in construction and in function to those of the first embodiment except for the lock unit 30 and few parts related to the lock unit 30.

Figure 9:
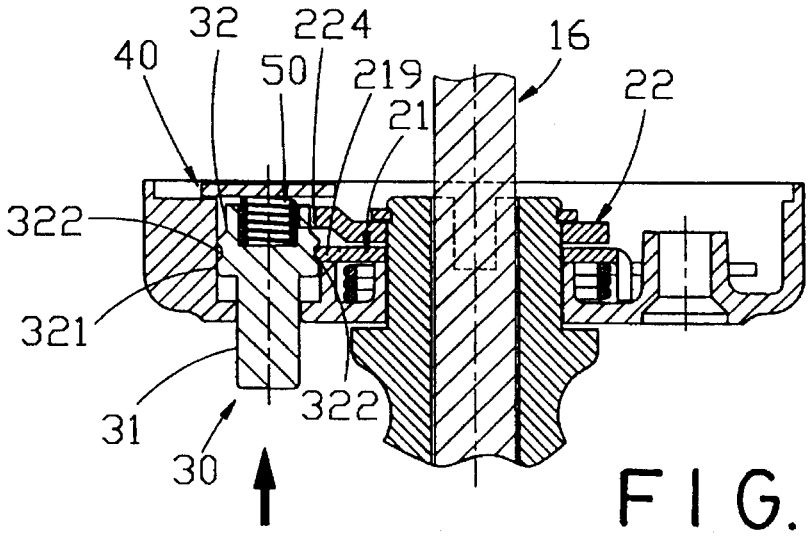
FIG. 9 is a sectional view, taken along line IX—IX of FIG. 8, showing the second embodiment of the inner handle assembly of this invention.
Figure 11:
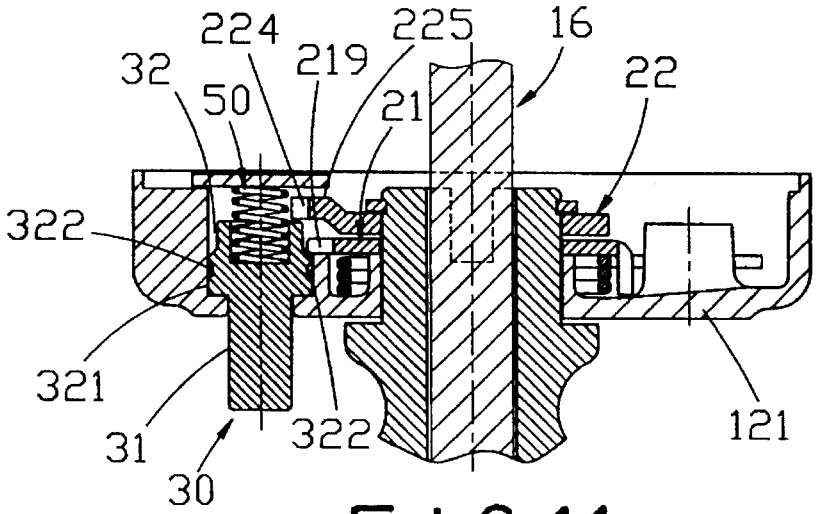
FIG. 11 is a sectional view, taken along line XI—XI of FIG. 10, showing the second embodiment of the inner handle assembly of this invention.

Referring to FIGS. 7 and 9, the lock unit 30 includes a button member 31 which extends outwardly through a through-hole 130 of the mounting cap 12 and which is mounted for movement along an axial direction between a locking position and an unlocking position, and a tubular engagement member 32 formed integrally with one end portion of the button member 31 and confined within an integrally formed tubular member 129 of the mounting cap 12. The engagement member 32 has a radially and outwardly extending flange 321 projecting from an outer peripheral surface thereof and engaging an inner surface of a transverse wall 121 of the mounting cap 12, as shown in FIG. 11, when the lock unit 30 is at the locking position, hereby preventing removal of the engagement member 32 from the mounting cap 12 via the through-hole 130. When the lock unit 30 is at the locking position, the outer peripheral surface of the engagement member 32 can engage a notched edge 224 of a radial projection 225 of the spindle driving plate 22 so as to block rotation of the spindle driving plate 22. In this way, the spindle 16 is locked by virtue of engagement between the engagement member 32 and the spindle driving plate 22 to lock the door lock.

Figure 8:
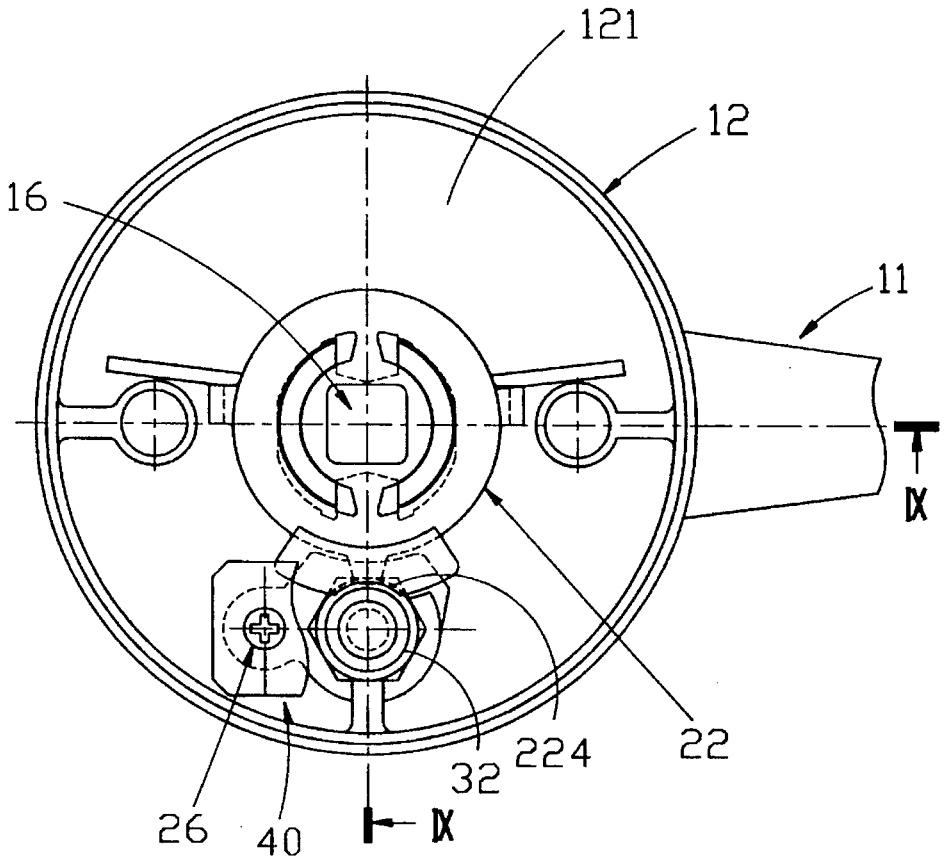
FIG. 8 is an elevational front view showing the second embodiment of the inner handle assembly of this invention.

Referring again to FIGS. 7 and 9, the engagement member 32 further has a circumferential groove 322 formed in the flange 321. The rotary member 21 has a tongue 219 projecting radially and outwardly from an outer peripheral edge of an annular plate 211 thereof. The button member 31 can be depressed manually to allow the tongue 219 to engage the circumferential groove 322 of the engagement member 32 when the handle 11 and the rotary member 21 are not rotated, as shown in FIGS. 8 and 9, thereby maintaining the lock unit 30 at its locking position.

Figure 10:
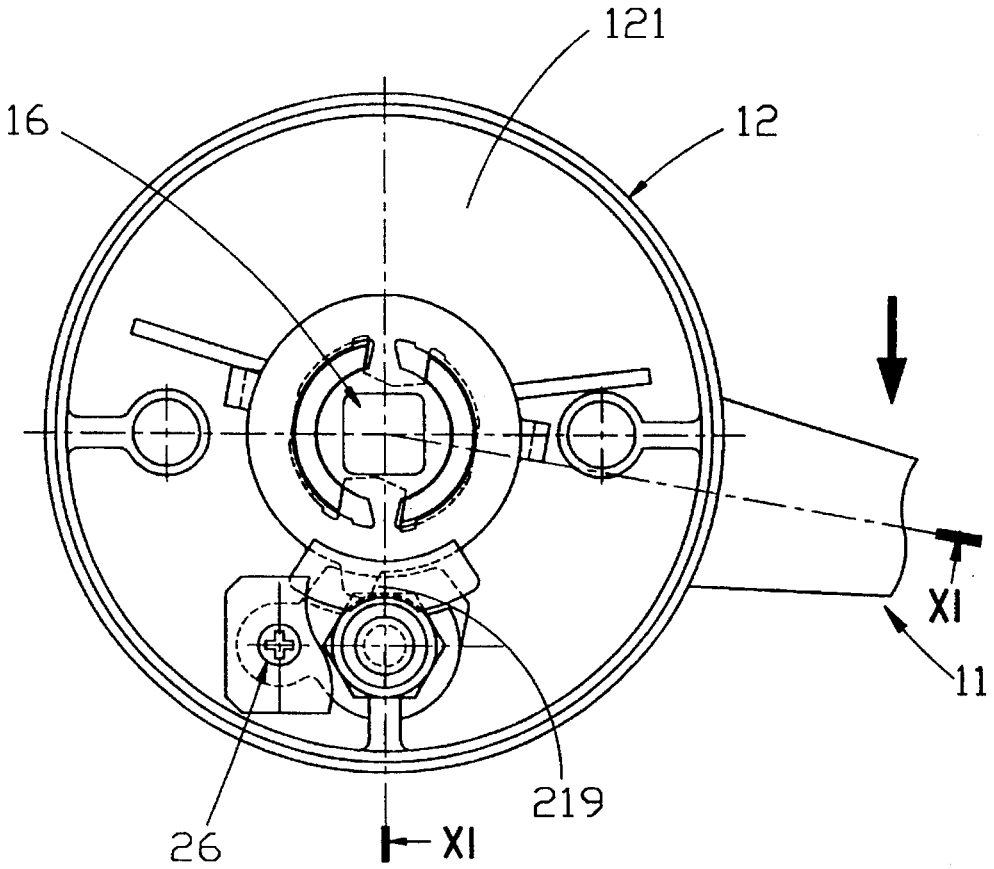
FIG. 10 is a schematic view illustrating operation of the inner handle assembly in accordance with the second embodiment of this invention.

Referring again to FIGS. 7 and 9, a cover plate 40 is secured to the mounting cap 12 by means of a bolt 26 so as to enclose the engagement member 32 within the mounting cap 12. A spring member 50 is disposed in a receiving space 323 of the engagement member 32 and protrudes outwardly to engage the cover plate 40 so as to store a biasing force in the spring member 50 when the lock unit 30 is at its locking position. When the handle 11 is turned to rotate the rotary member 21 to a predetermined angle, as shown in FIGS. 10 and 11, the tongue 219 of the rotary member 21 is moved away from the circumferential groove 322 of the engagement member 32. Thus, the biasing force of the spring member 50 can bias the locking unit 30 to its unlocking position so as to disengage the outer peripheral surface of the engagement member 32 from the notched edge 224 of the projection 225 of the spindle driving plate 22. In this situation, the spindle driving plate 22 can be rotated successively by virtue of rotation of the axle 112 so as to rotate the spindle 16 to unlock the door lock.

Figure 12:
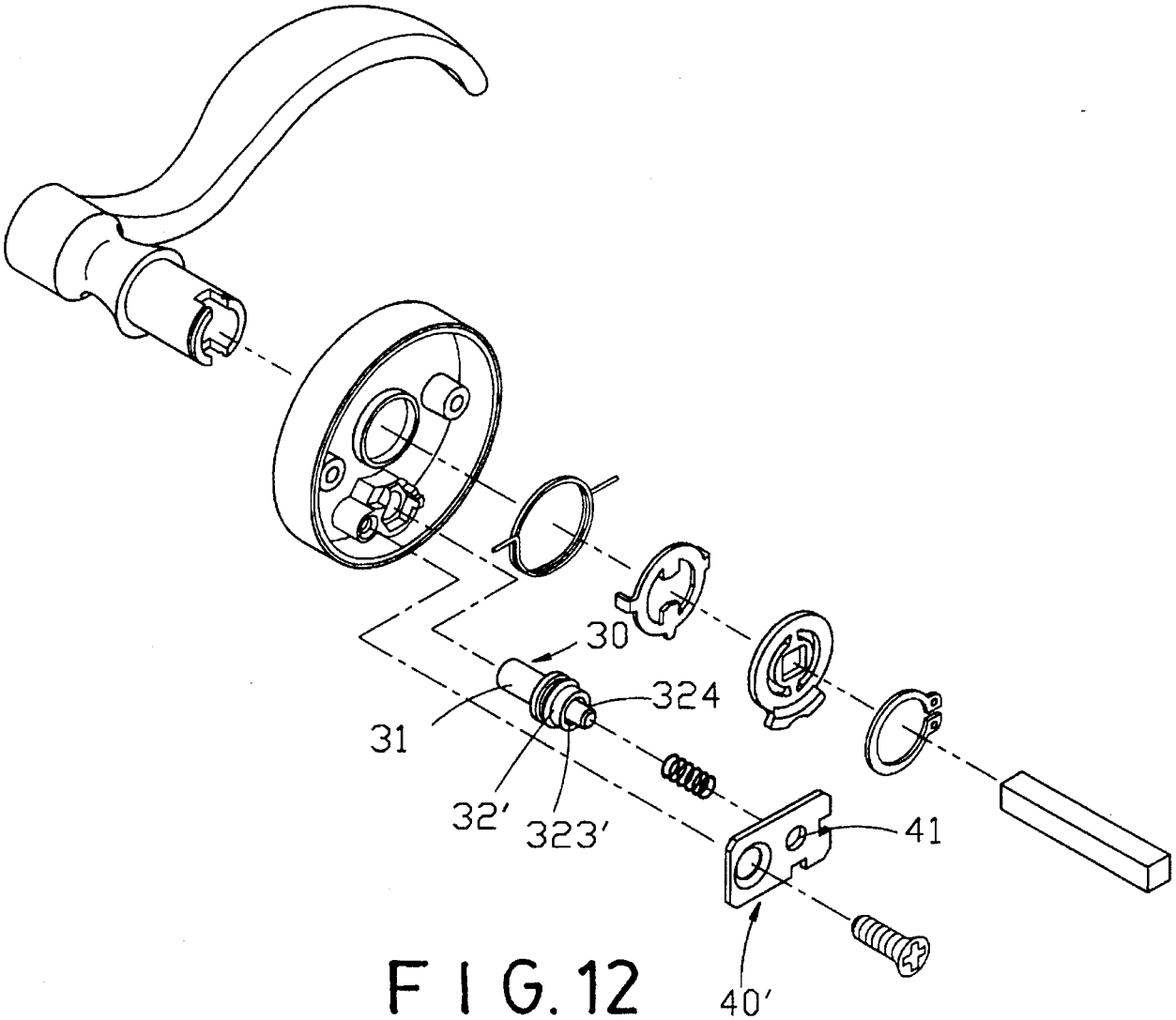
FIG. 12 is an exploded view showing the third preferred embodiment of an inner handle assembly of a door lock according to this invention.
Figure 13:
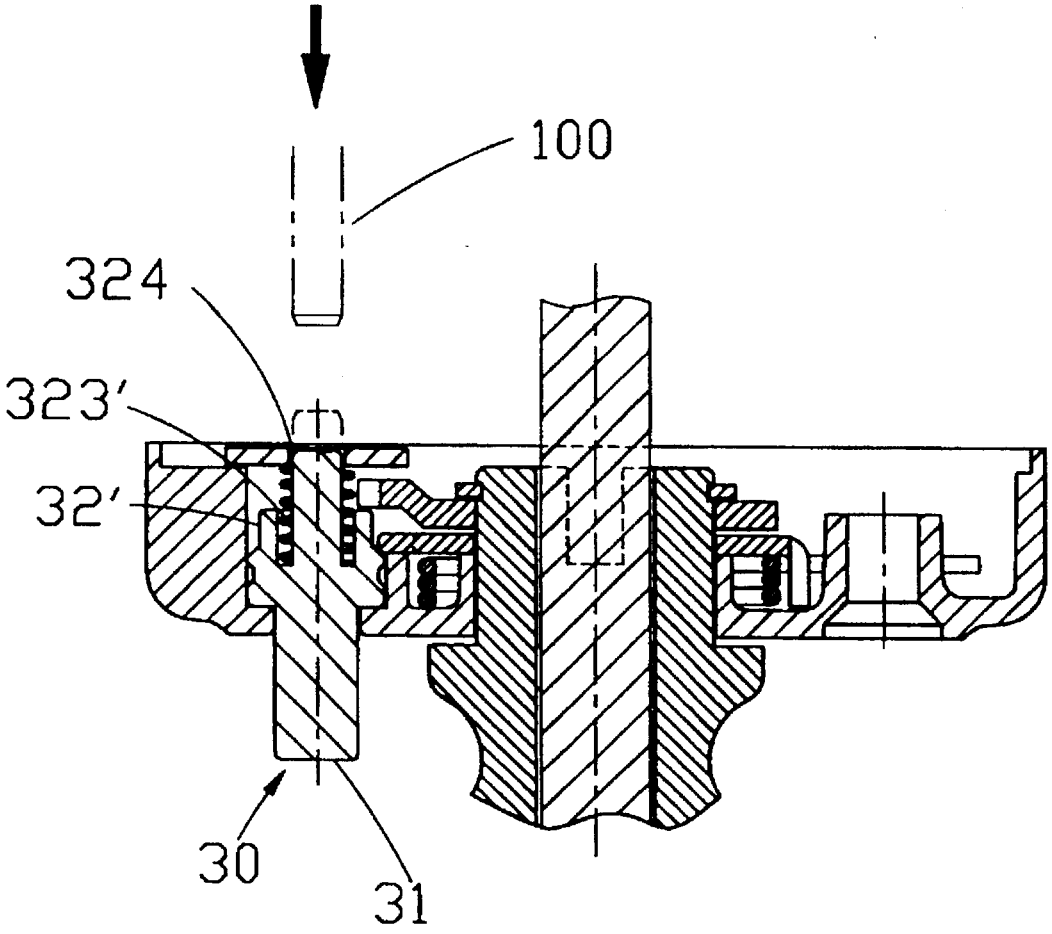
FIG. 13 is a sectional view illustrating operation of the inner handle assembly in accordance with the third embodiment of this invention.

FIGS. 12 and 13 show a modified engagement member 32' of a manually operable lock unit 30 of the third preferred embodiment of an inner handle assembly of a door lock of this invention. As shown, the engagement member 32' further has an axially and inwardly extending bar 324 projecting from one end surface of a button member 31 of the lock unit 30 through a receiving space 323' of the engagement member 32' and a hole 41 of a cover plate 40' of the inner handle assembly of the door lock. An outer mounting cap of an outer handle assembly (not shown) also has a hole formed therethrough and aligned and communicated with the hole 41 of the cover plate 40'. Accordingly, in case of an emergency, the user can insert a rod 100 (see FIG. 13) from the hole of the outer mounting cap to depress forcibly against the bar 324 so as to push the lock unit 30 to its unlocking position, thereby unlocking the door lock.

Figure 14:
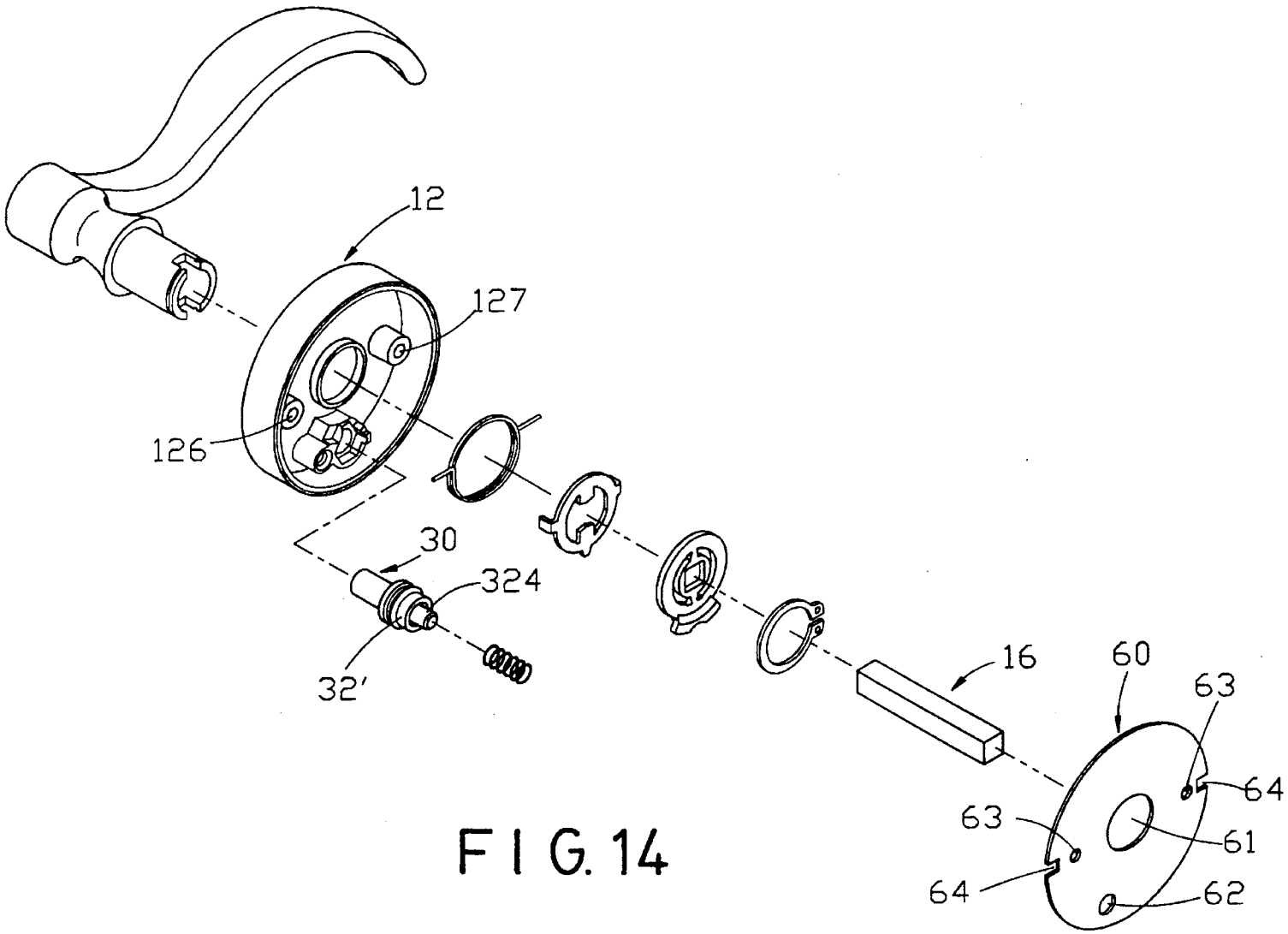
FIG. 14 is an exploded view showing the fourth preferred embodiment of an inner handle assembly of a door look according to this invention.
Figure 15:
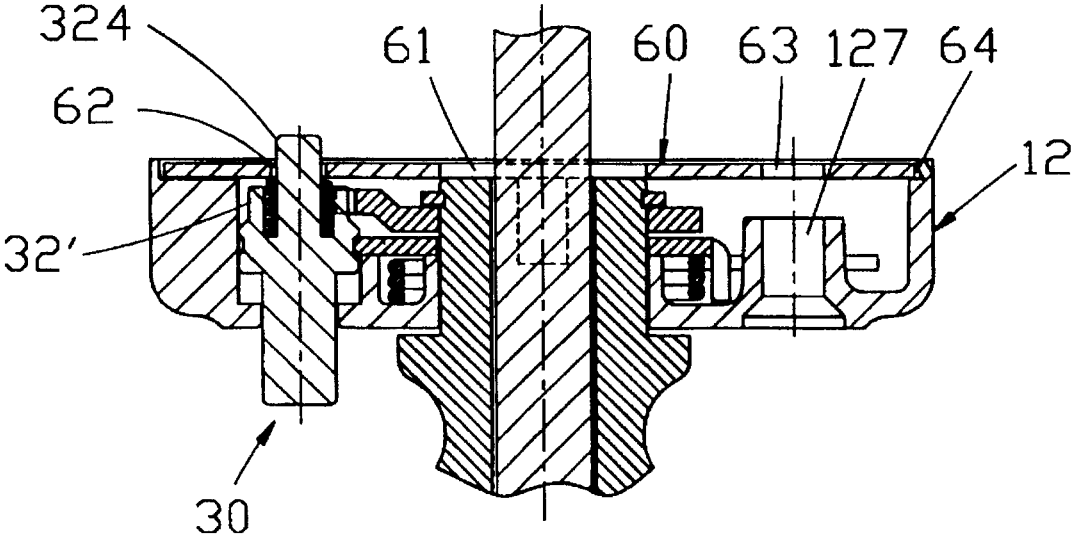
FIG. 15 is a sectional view showing the fourth embodiment of the inner handle assembly of this invention.

FIGS. 14 and 15 show a modified cover plate 60 of the fourth preferred embodiment of an inner handle assembly of this invention. As shown, the cover plate 60 is a circular plate with a size sufficient for fastening to an inner peripheral edge of the mounting cap 12 so as to cover completely the mounting cap 12. The cover plate 60 has a central hole 61 for passage of a spindle 16, a hole 62 for passage of an axially extending bar 324 of an engagement member 32' of a locking unit 30 of the inner handle assembly, and a pair of diametrically opposite holes 63 aligned respectively with two internally threaded holes 126, 127 of the mounting cap 12 so as to allow two bolts (not shown) extending through the internally threaded holes 126, 127 and the holes 63 to engage an inner wall of a door, thereby fixing the mounting cap 12 to the door. A pair of diametrically opposite notches 64 are formed in an outer circumferential edge of the cover plate 60 so as to facilitate fastening of the cover plate 60 on the mounting cap 12 by means of rivets.

Figure 16:
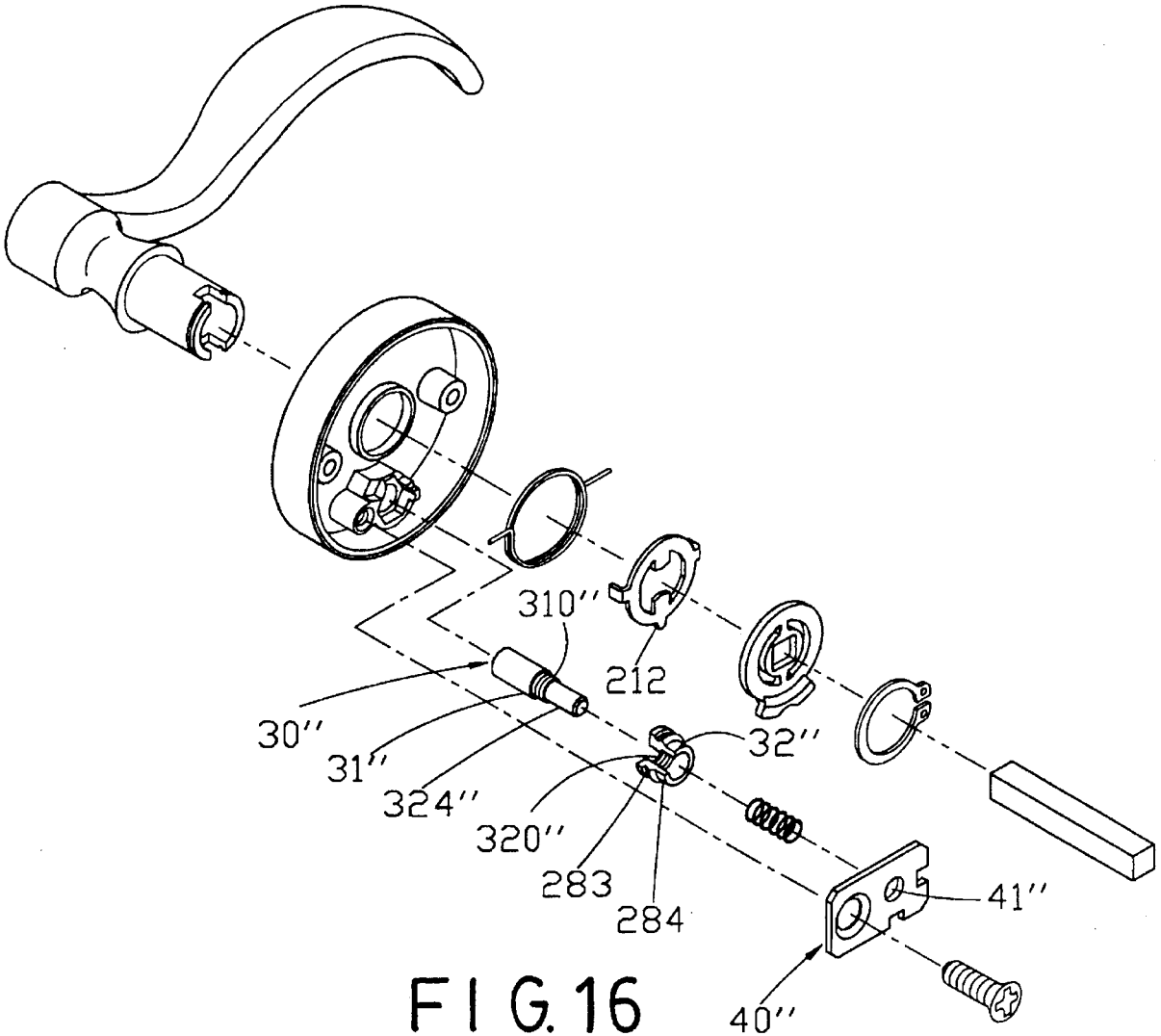
FIG. 16 is an exploded view showing the fifth preferred embodiment of an inner handle assembly of a door lock according to his invention.

FIG. 16 shows a modified manually operable lock unit 30" of the fifth preferred embodiment of an inner handle assembly of this invention. As shown, the lock unit 30" includes a button member 31" which has an externally threaded portion 310" formed on a mounting end thereof, and a tubular engagement member 32" which has an internally threaded portion 320" formed on a mounting end thereof for engaging threadably the externally threaded portion 310" of the button member 31" so as to mount securely the engagement member 32" on the button member 31". The mounting end of the button member 31" is provided with an axially and inwardly extending bar 324" which is surrounded by the tubular engagement ember 32" and which extends through a hole 41" of a cover plate 40" of the inner handle assembly for emergency use.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements,

We claim:

1. An inner handle assembly of a door lock, the door lock having a spindle connecting said inner handle assembly to an outer handle assembly of the door lock for actuating a bolt of the door lock by virtue of operation of said inner handle assembly or the outer handle assembly in order to open the door, said inner handle assembly comprising:

a handle having an axle;

a mounting cap provided around said axle and having an axial hole for passage of said axle and a through-hole offset from said axial hole;

a spindle driving plate having a central hole adapted to engage fittingly the spindle;

a manually operable lock unit having a button member which extends outwardly through said through-hole of said mounting cap and which is mounted for movement in an axial direction between a locking position and an unlocking position, and an engagement member in connection with said button member, said engagement member engaging said spindle driving plate for locking against rotation of said spindle driving plate without being restricted from axial movement relative to said spindle driving plate when said manually operable lock unit is at said locking position; and a rotary member mounted on said axle of said handle within said mounting cap for rotating simultaneously with said axle, said rotary member having means for moving said engagement member axially and outwardly of said mounting cap to disengage said engagement member from said spindle driving plate when said axle is turned to rotate said rotary member;

said axle of said handle having connecting means connected to said spindle driving plate for retarding rotation of said spindle driving plate so that said spindle driving plate starts to rotate after said manually operable lock unit is moved to said unlocking position.

2. An inner handle assembly of a door lock as claimed in claim 1, wherein said axle of said handle has a joint end adjacent to said spindle driving plate, said connecting means having at least one arcuate driving wing which projects axially from and which is formed integrally with said joint end of said axle, said spindle driving plate having at least one arcuate receiving slot formed therein to engage said driving wing, said receiving slot being slightly longer than said driving wing and said driving wing being limitedly slidable in said receiving slot so that commence of rotation of said spindle driving plate lags behind that of said axle.

3. An inner handle assembly of a door lock as claimed in claim 1, wherein said mounting cap further has an integrally formed tubular member projecting inwardly around said through-hole to guide and mount said manually operable lock unit, and a cover plate secured to said mounting cap to cover said integrally formed tubular member.

4. An inner handle assembly of a door lock as claimed in claim 1, wherein said spindle driving plate has an outer peripheral edge and a projection extending radially and outwardly from said outer peripheral edge, said projection being engageable with said engagement member against rotation of said spindle driving plate while being slidable axially relative to said engagement member.

5. An inner handle assembly of a door lock as claimed in claim 4, wherein said engagement member has a tubular body with a peripheral surface.

6. An inner handle assembly of a door lock as claimed in claim 5, wherein said projection has a notched edge to ride on and to engage said peripheral surface of said tubular body.

7. An inner handle assembly of a door look as claimed in claim 6, wherein said engagement member further has a stud projecting radially from said peripheral surface of said tubular body, said rotary member having an annular plate with an outer peripheral edge, said moving means of said rotary member having a cam part projecting radially and outwardly from said outer peripheral edge of said annular plate to engage said stud of said engagement member so as to cam said manually operable lock unit to said unlocking position after said rotary member is rotated.

8. An inner handle assembly of a door lock as claimed in claim 7, wherein said cam part is a curved plate having a concaved surface to receive said stud of said engagement member when said locking unit is depressed to said locking position, and a gradually convexed surface for camming and pushing said stud of said engagement member when said rotary member is rotated.

* * * * *